US012808593B2

(12) United States Patent
Schroeder et al.

(10) Patent No.: US 12,808,593 B2
(45) Date of Patent: Nov. 24, 2026

(54) REFRIGERATOR APPLIANCE CHILLED AIR SYSTEM

(71) Applicant: Haier US Appliance Solutions, Inc., Wilmington, DE (US)

(72) Inventors: Michael Goodman Schroeder, Crestwood, KY (US); Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 145 days.

(21) Appl. No.: 18/632,907

(22) Filed: Apr. 11, 2024

(65) Prior Publication Data

US 2025/0321043 A1 Oct. 16, 2025

(51) Int. Cl.
*F25D 17/06* (2006.01)

(52) U.S. Cl.
CPC ..... *F25D 17/065* (2013.01)

(58) Field of Classification Search
CPC ..... F25D 17/065; F25D 2317/0653; F25D 2317/0663; F25D 2400/04
See application file for complete search history.

(56) References Cited

U.S. PATENT DOCUMENTS

| | | | | |
|---|---|---|---|---|
| 4,009,589 | A | 3/1977 | Webb et al. | |
| 5,224,358 | A | 7/1993 | Yamanaka et al. | |
| 5,642,628 | A | 7/1997 | Whipple, III et al. | |
| 6,725,680 | B1 * | 4/2004 | Schenk | F25D 29/00 62/186 |
| 6,880,359 | B2 | 4/2005 | Pearson et al. | |
| 10,247,466 | B2 | 4/2019 | Tao et al. | |
| 11,391,501 | B2 | 7/2022 | Junge et al. | |
| 11,486,625 | B2 | 11/2022 | Wetekamp et al. | |
| 2006/0266075 | A1 * | 11/2006 | Itsuki | F25B 40/00 62/512 |
| 2013/0098075 | A1 | 4/2013 | Hegedus et al. | |

(Continued)

FOREIGN PATENT DOCUMENTS

| | | | |
|---|---|---|---|
| CN | 109737668 | A * | 5/2019 |
| CN | 109737668 | B | 11/2020 |
| JP | 2013127345 | A | 6/2013 |

(Continued)

OTHER PUBLICATIONS

CN-109737668-A translation.*

*Primary Examiner* — Elizabeth J Martin
(74) *Attorney, Agent, or Firm* — Dority & Manning, P.A.

(57) ABSTRACT

A refrigerator appliance includes a cabinet with a fresh food chamber and a freezer defined in the cabinet. A bridge chamber is defined in the cabinet between the fresh food chamber and the freezer chamber. The bridge chamber includes a first inlet and a first outlet in fluid communication with the fresh food chamber, as well as a second inlet and a second outlet in fluid communication with the freezer chamber. The refrigerator appliance also includes an evaporator and a fan positioned in the bridge chamber. The refrigerator appliance further includes a movable damper assembly configured to move between a first position and a second position. The second inlet and the second outlet are obstructed by the damper assembly in the first position and the first inlet and the first outlet are obstructed by the damper assembly in the second position.

12 Claims, 7 Drawing Sheets

(56) References Cited

U.S. PATENT DOCUMENTS

| | | | | |
|---|---|---|---|---|
| 2018/0224183 | A1* | 8/2018 | Besore | F25D 17/065 |
| 2023/0213267 | A1 | 7/2023 | Gupta et al. | |

FOREIGN PATENT DOCUMENTS

| | | | |
|---|---|---|---|
| JP | 2014234967 | A | 12/2014 |
| KR | 101770128 | B1 | 8/2017 |
| KR | 101954198 | B1 | 3/2019 |
| WO | WO2018121592 | A1 | 7/2018 |

* cited by examiner

REFRIGERATOR APPLIANCE CHILLED AIR SYSTEM

FIELD

The present subject matter relates generally to refrigerator appliances, and more particularly to a features for generating and distributing chilled air within refrigerator appliances, such as chilled air systems which include a single evaporator for multiple chilled chambers of the refrigerator appliances.

BACKGROUND

Refrigerator appliances generally include a cabinet that defines chilled chambers for receipt of food items for storage. Insulated, sealing doors are provided for selectively enclosing the chilled food storage chambers.

Refrigerator appliances typically utilize sealed systems for cooling the chilled chambers. A typical sealed system includes an evaporator and a fan, however, such refrigerator appliances usually include a separate evaporator for each chamber to achieve different temperatures in each of the chilled chambers.

Additional evaporators may result in added costs, more complicated assembly, a more complex refrigerant plumbing configuration, and reduced proportion of usable space within the internal volume of the refrigerator appliance.

Accordingly, a refrigerator appliance including a single evaporator for providing chilled air to multiple chambers therein is desired in the art.

BRIEF DESCRIPTION

Aspects and advantages of the invention will be set forth in part in the following description, or may be apparent from the description, or may be learned through practice of the invention.

In one exemplary embodiment, a refrigerator appliance is provided. The refrigerator appliance includes a cabinet with a fresh food chamber and a freezer defined in the cabinet. The freezer chamber is spaced apart from the fresh food chamber and separated from the fresh food chamber by an insulated mullion. A bridge chamber is defined in the cabinet. The bridge chamber is positioned between the fresh food chamber and the freezer chamber. The bridge chamber includes a first inlet in fluid communication with the fresh food chamber, a first outlet in fluid communication with the fresh food chamber, a second inlet in fluid communication with the freezer chamber, and a second outlet in fluid communication with the freezer chamber. The refrigerator appliance also includes an evaporator positioned in the bridge chamber and a fan positioned in the bridge chamber. The refrigerator appliance further includes a movable damper assembly configured to move between a first position and a second position. The second inlet and the second outlet are obstructed by the damper assembly in the first position and the first inlet and the first outlet are obstructed by the damper assembly in the second position.

In another exemplary embodiment, a method of operating a refrigerator appliance is provided. The refrigerator appliance includes a cabinet with a fresh food chamber and a freezer chamber defined in the cabinet. The freezer chamber is spaced apart from the fresh food chamber and separated from the fresh food chamber by an insulated mullion. The refrigerator appliance also includes a bridge chamber defined in the cabinet. The bridge chamber is positioned between the fresh food chamber and the freezer chamber.

The bridge chamber includes a first inlet in fluid communication with the fresh food chamber, a first outlet in fluid communication with the fresh food chamber, a second inlet in fluid communication with the freezer chamber, a second outlet in fluid communication with the freezer chamber. The refrigerator appliance also includes a movable damper assembly, an evaporator positioned in the bridge chamber, and a fan positioned in the bridge chamber. The method includes moving the movable damper assembly to a first position, whereby the second inlet and the second outlet are obstructed by the damper assembly in the first position, and moving the movable damper assembly to a second position, whereby the first inlet and the first outlet are obstructed by the damper assembly in the second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
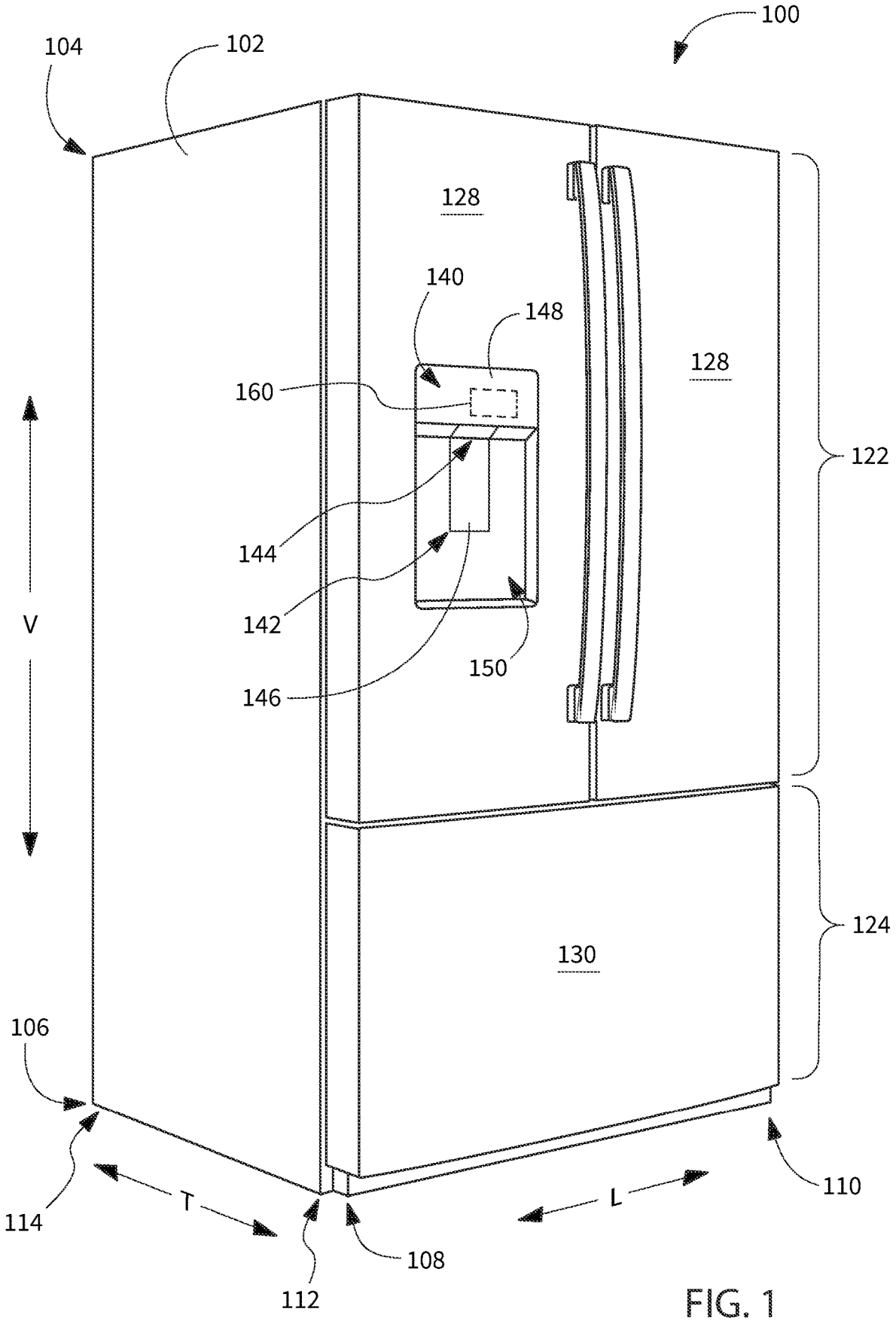
FIG. 1 provides a perspective view of a refrigerator appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms “first,” “second,” and “third” may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
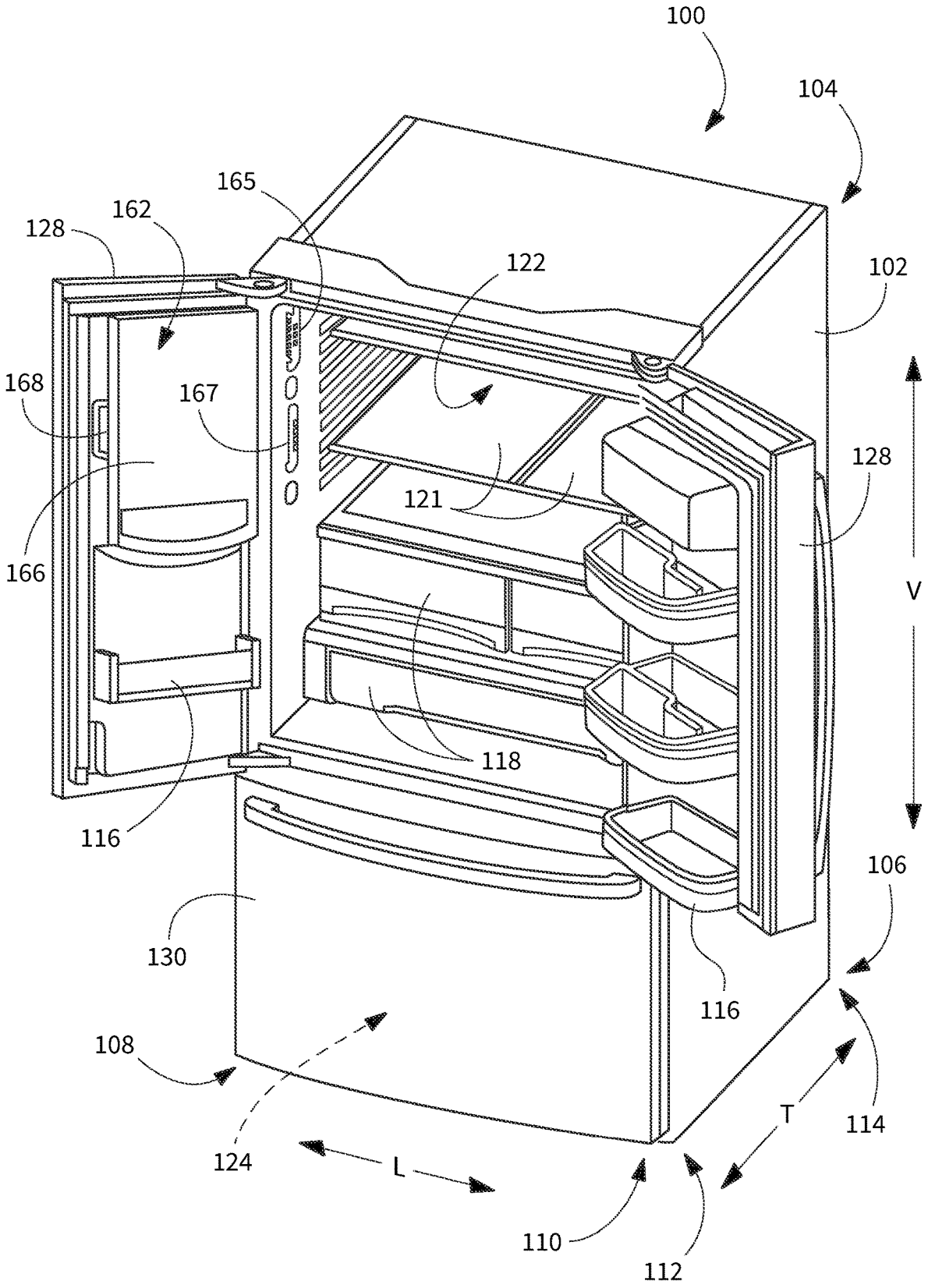
FIG. 2 provides an additional perspective view of the exemplary refrigerator appliance of FIG. 1 with doors of the refrigerator appliance in an open position.

Referring now to the figures, FIGS. 1 and 2 provide perspective views of an exemplary refrigerator appliance 100, according to one or more exemplary embodiments of the present subject matter. The refrigerator appliance may define a vertical direction V, a lateral direction L, and a transverse direction T. The vertical direction V, the lateral direction L, and the transverse direction T may each be mutually perpendicular to one another to generally form an orthogonal coordinate system.

As illustrated in FIGS. 1 and 2, the refrigerator appliance 100 may include a housing or a cabinet 102 that may extend between a top 104 and a bottom 106 approximately along a vertical direction V, between a first side (left side) 108 and a second side (right side) 110 approximately along a lateral direction L, and between a front 112 and a back 114 approximately along a transverse direction T. The cabinet 102 may define one or more chilled chambers for receipt of food items for storage. In some embodiments, the cabinet 102 may define a fresh food chamber 122 positioned at or adjacent the top 104 of the cabinet 102 and a freezer chamber 124 arranged at or adjacent the bottom 106 of the cabinet 102. As such, the refrigerator appliance 100 may generally be referred to as a bottom mount refrigerator.

It is recognized, however, that the benefits of the present disclosure apply to other types and styles of refrigerator appliances such as, for example, a top mount refrigerator appliance, a quad door refrigerator appliance, a side-by-side refrigerator, or other similar refrigerator appliances. Consequently, the description set forth herein is for illustrative purposes only and is not intended to be limiting in any aspect to any particular household appliance, such as the present subject matter is not limited to any particular refrigerator chamber configuration. Accordingly, it should be recognized that aspects of the present disclosure may be used with a variety of refrigerator appliances.

The refrigerator doors 128 may be rotatably hinged to an edge of the cabinet 102 for selectively accessing the fresh food chamber 122. In addition, a freezer door 130 may be arranged below the refrigerator doors 128 for selectively accessing the freezer chamber 124. The freezer door 130 may be coupled to a freezer drawer 132 (see, e.g., FIGS. 3 and 5) slidably mounted within the freezer chamber 124. The refrigerator doors 128 and the freezer door 130 are shown in the closed configuration in FIG. 1.

In some embodiments, various storage components may be mounted within the fresh food chamber 122 to facilitate storage of food items therein. In particular, the storage components may include storage bins 116, drawers 118, and shelves 121 that may be mounted within the fresh food chamber 122. As such, the storage bins 116, drawers 118, and shelves 121 are configured for receipt of food items, for example, beverages or solid food items, and may assist with organizing such food items. As an example, the drawers 118 can receive fresh food items, for example, vegetables, fruits, or cheeses, and increase the useful life of such fresh food items.

In some embodiments, the refrigerator appliance 100 may also include a dispensing assembly 140 for dispensing liquid water or ice. The dispensing assembly 140 may include a dispenser 142, for example, positioned on or mounted to an exterior portion of the refrigerator appliance 100, such as on one of the refrigerator doors 128. Moreover, as shown in FIG. 1, the dispenser 142 may include a discharging outlet 144 for accessing ice and liquid water. Further, an actuating mechanism 146, shown as a paddle, may be mounted below the discharging outlet 144 for operating the dispenser 142. In alternative embodiments, any suitable actuating mechanism may be used to operate the dispenser 142. A user interface panel 148 may also be provided for controlling the mode of operation. For example, the user interface panel 148 may include a plurality of user inputs (not labeled), such as a water dispensing button and an ice-dispensing button, for selecting a desired mode of operation such as crushed or non-crushed ice.

Still referring to FIG. 1, the discharging outlet 144 and actuating mechanism 146 may be an external part of the dispenser 142 and may be mounted in a dispenser recess 150. The dispenser recess 150 may be positioned at a predetermined elevation convenient for a user to access ice or water and enabling the user to access ice without the need to bend over and without the need to open the refrigerator doors 128. In additional embodiments, the dispenser recess 150 may be positioned at a level that approximates the chest level of a user.

In further embodiments, for example, as shown in FIG. 2, the refrigerator appliance 100 may include a sub-compartment 162 defined on the refrigerator door 128. The sub-compartment 162 is often referred to as an "icebox." Further, the sub-compartment 162 may extend into fresh food chamber 122 when the refrigerator door 128 is in the closed position. Although the sub-compartment 162 is shown in the refrigerator door 128, additional or alternative embodiments may include the sub-compartment 162 fixed within fresh food chamber 122. In an embodiment, an ice maker and/or an ice storage bin (not shown) may be positioned or disposed within the sub-compartment 162. Accordingly, during use, ice can be supplied to the dispenser recess 150, see, for example, FIG. 1, from the ice making assembly or ice storage bin in the sub-compartment 162 on a back side of refrigerator door 128.

In additional or alternative embodiments, chilled air from a sealed system of the refrigerator appliance 100 may be directed into components within the sub-compartment 162. For instance, the sub-compartment 162 may receive cooling air from a chilled air supply duct 165 and a chilled air return duct 167 (see, for example, FIG. 2), disposed on a side portion of cabinet 102 of the refrigerator appliance 100. In this manner, the chilled air supply duct 165 and the chilled air return duct 167 may recirculate chilled air from a suitable sealed cooling system through the sub-compartment 162.

In optional embodiments, for example, as illustrated in FIG. 2, an access door 166 may be hinged to the refrigerator door 128. Thus, the access door 166 may permit selective access to the sub-compartment 162. Any manner of suitable latch 168 may be configured with the sub-compartment 162 to maintain the access door 166 in a closed position. As an example, the latch 168 may be actuated by a user in order to open the access door 166 for providing access into the sub-compartment 162. The access door 166 can also assist with insulating the sub-compartment 162 (e.g., by thermally isolating or insulating the sub-compartment 162 from the fresh food chamber 122). It is noted that although the access door 166 is illustrated in exemplary embodiments, alternative embodiments may be free of any separate access door.

Refrigerator appliance 100 further includes a controller 160. Operation of the refrigerator appliance 100 is regulated by controller 160 that is operatively coupled to user interface panel 148. In some exemplary embodiments, user interface panel 148 may represent a general purpose I/O ("GPIO") device or functional block. In some exemplary embodiments, user interface panel 148 may include input components, such as one or more of a variety of electrical, mechanical or electro-mechanical input devices including rotary dials, push buttons, touch pads, and touch screens. User interface panel 148 can be communicatively coupled with controller 160 via one or more signal lines or shared communication busses. User interface panel 148 provides selections for user manipulation of the operation of refrigerator appliance 100, e.g., whereby a user may provide one or more set point temperatures for the various chilled chambers 122 and 124. In response to user manipulation of the user interface panel 148, controller 160 operates various components of refrigerator appliance 100. For example, controller 160 is operatively coupled or in communication with various airflow components, e.g., dampers and fans, as discussed below. Controller 160 may also be communicatively coupled with a variety of sensors, such as, for example, chamber temperature sensors or ambient temperature sensors. Such chamber temperature sensors and/or ambient temperature sensors may be or include thermistors, thermocouples, or any other suitable temperature sensor. Controller 160 may receive signals from these temperature sensors that correspond to the temperature of an atmosphere or air within their respective locations.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 160 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 160 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware.

Additionally, or alternatively, the instructions can be executed logically and/or virtually using separate threads on one or more processors.

For example, controller 160 may be operable to execute programming instructions or micro-control code associated with an operating cycle of refrigerator appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 160 as disclosed herein is capable of and may be operable to perform any methods, method steps, or portions of methods as disclosed herein. For example, in some embodiments, methods disclosed herein may be embodied in programming instructions stored in the memory and executed by controller 160.

The memory devices may also store data that can be retrieved, manipulated, created, or stored by the one or more processors or portions of controller 160. The data can include, for instance, data to facilitate performance of methods described herein. The data can be stored locally (e.g., on controller 160) in one or more databases and/or may be split up so that the data is stored in multiple locations. In addition, or alternatively, the one or more database(s) can be connected to controller 160 through any suitable network(s), such as through a high bandwidth local area network (LAN) or wide area network (WAN). In this regard, for example, controller 160 may further include a communication module or interface that may be used to communicate with one or more other component(s) of refrigerator appliance 100, controller 160, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring now to FIGS. 3 through 6 generally, the refrigerator appliance 100 may include an insulated mullion 170 between the fresh food chamber 122 and the freezer chamber 124. For example, the freezer chamber 124 may be spaced apart from the fresh food chamber 122 and separated from the fresh food chamber 122 by the insulated mullion 170, such that the insulated mullion 170 partially defines each of the fresh food chamber 122 and the freezer chamber 124, and where the thermal insulation of the insulated mullion 170 promotes operation of the fresh food chamber 122 and the freezer chamber 124 at distinct temperatures, as is understood by those of ordinary skill in the art.

The refrigerator appliance 100 may further include a bridge chamber 200. The bridge chamber 200 may be partially, e.g., on at least one side, defined by the insulated mullion 170. The bridge chamber 200 may further be defined by one or more additional insulated partitions 202, such that the bridge chamber 200 may be operated at a distinct temperature from the operating temperature of one or both of the fresh food chamber 122 and freezer chamber 124. The bridge chamber 200 may include a first inlet 204 in fluid communication with the fresh food chamber 122 and a first outlet 206 in fluid communication with the fresh food chamber 122. The bridge chamber 200 may further include a second inlet 208 in fluid communication with the freezer chamber 124 and a second outlet 210 in fluid communication with the freezer chamber 124. The refrigerator appliance 100 may further include a movable damper assembly, such as four independently movable dampers, e.g., a first damper 212, a second damper 214, a third damper 216, and a fourth damper 218. The movable damper assembly may be movable between multiple various positions, such as a first position, e.g., for a fresh food mode, and a second position, e.g., for a freezer mode.

The refrigerator appliance 100 may further include a sealed cooling system, as is generally understood by those of ordinary skill in the art. For example, the sealed cooling system may include a sealed refrigerant loop with heat exchangers coupled in line with the sealed refrigerant loop (e.g., for series flow through the sealed refrigerant loop and successively through the heat exchangers). The heat exchangers may include a condenser (not shown), in which vapor phase refrigerant condenses to liquid phase, thereby releasing heat to the external environment at the condenser, and an evaporator 220, in which liquid phase refrigerant absorbs heat from the external environment (e.g., air around the evaporator 220) and thereby vaporizes, such that a flow of chilled air may be generated at and around the evaporator 220. A fan 222 may be positioned proximate to the evaporator 220, such that the fan 222 is sufficiently close to the evaporator 220 to urge the chilled air generated at the evaporator 220 to or towards one of the chilled chambers (fresh food chamber 122 and freezer chamber 124) of the refrigerator appliance 100.

Figure 5:
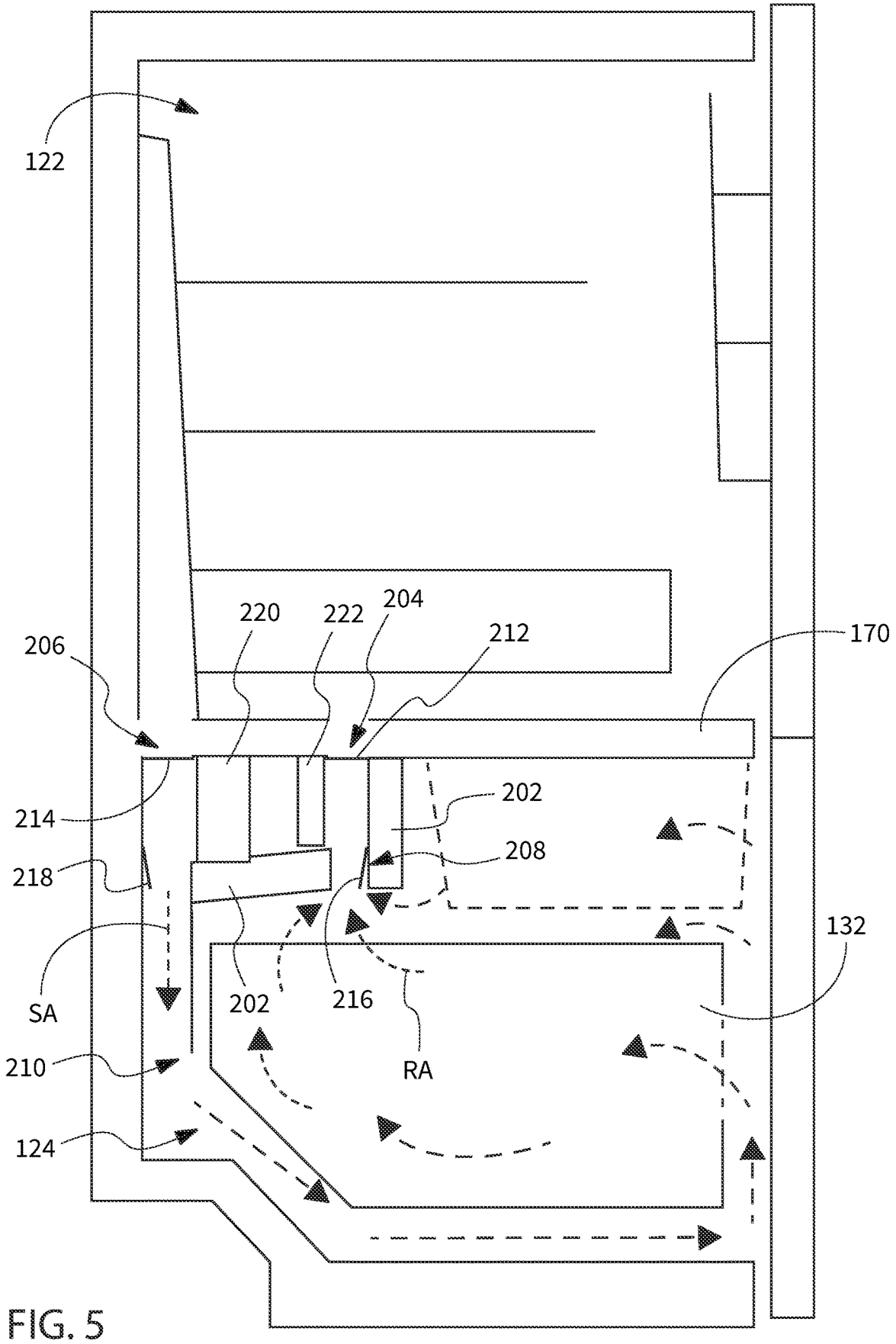
FIG. 5 provides a schematic side section view of the exemplary refrigerator appliance of FIG. 1 with the damper assembly in a second position.
Figure 6:
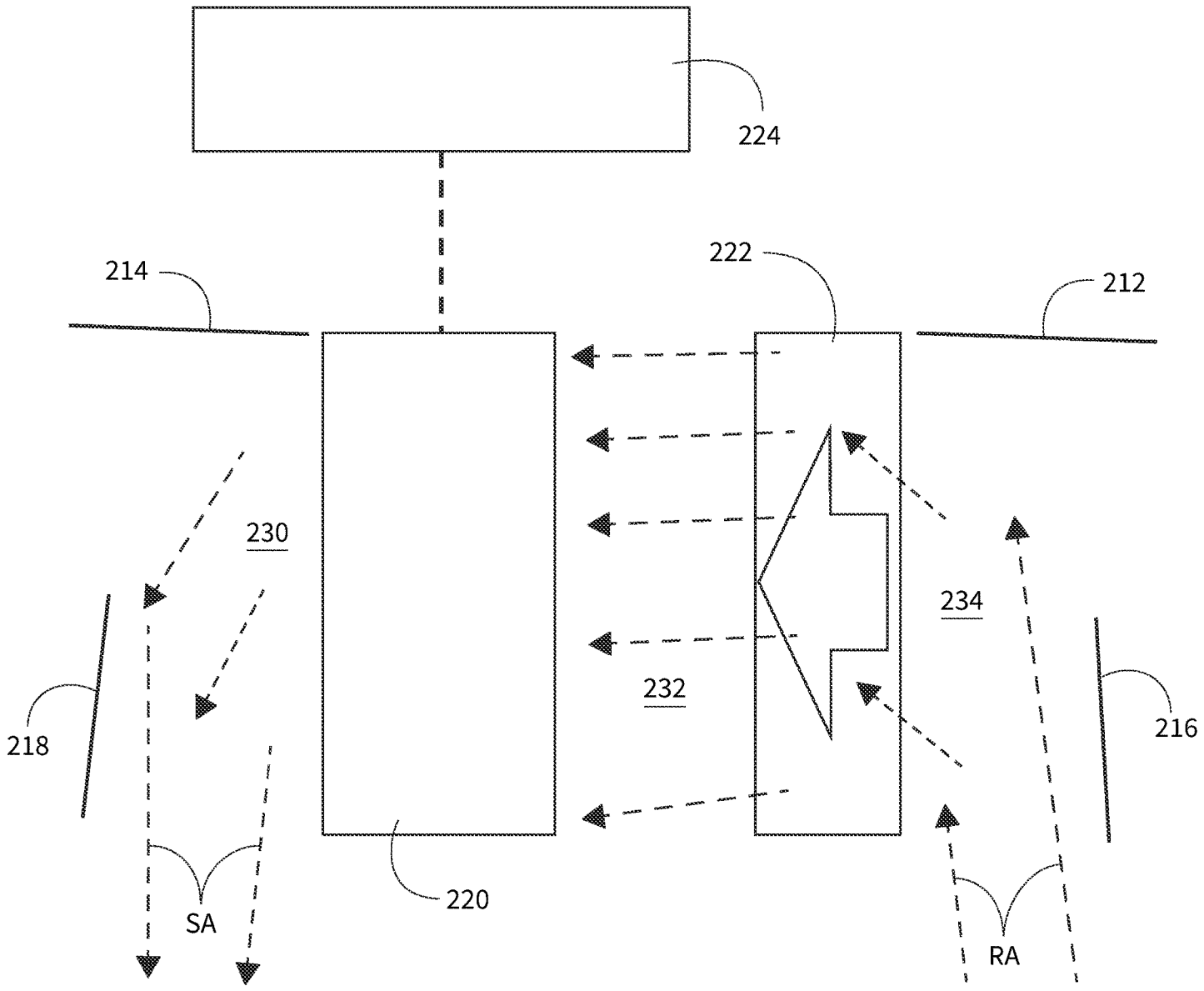
FIG. 6 provides an enlarged view of a portion of FIG. 5.

In particular, the evaporator 220 and the fan 222 may be positioned in the bridge chamber 200, such that the flow of chilled air urged by the fan 222 may be directed from the bridge chamber 200 to one or the other (or both) of the fresh food chamber 122 and the freezer chamber 124. For example, the flow of chilled air from the bridge chamber 200 (urged by fan 222) may be obstructed from one of the chambers and directed to the other of the chambers by the movable damper assembly. As mentioned above, the movable damper assembly may be movable between a first position and a second position, such as the third damper 216 may obstruct the second inlet 208 and the fourth damper 218 may obstruct the second outlet 210 in the first position (FIGS. 3 and 4), whereas the first damper 212 may obstruct the first inlet 204 and the second damper 214 may obstruct the first outlet 206 in the second position (FIGS. 5 and 6). Thus, the movable damper assembly may obstruct the flow of chilled air from the bridge chamber 200 to the freezer chamber 124 in the first position, and may direct the flow of chilled air from the bridge chamber 200 into the fresh food chamber 122 in the first position. Similarly, when the damper assembly is in the second position, the movable damper assembly may obstruct the flow of chilled air from the bridge chamber 200 to the fresh food chamber 122 and guide or direct the flow of chilled air from the bridge chamber 200 to the freezer chamber 124.

In at least some embodiments, the evaporator 220 in the bridge chamber 200 may be the only evaporator 220 in the sealed cooling system, such as the evaporator 220 in the bridge chamber 200 may be the only evaporator of the refrigerator appliance 100. Thus, for example, the movable damper assembly may provide selective cooling to one or the other of the fresh food chamber 122 and the freezer chamber 124, such that the single evaporator 220 for the entire refrigerator appliance 100 may provide cooling to both chilled chambers 122 and 124.

In at least some embodiments, the movable damper assembly may also be movable to an intermediate position, e.g., a fully open or all open position, such that chilled air from the bridge chamber 200 may be directed to both chilled chambers 122 and 124 at the same time, such as in a cool down mode. For example, the cool down mode may be implemented when the refrigerator appliance is first commissioned, after a power outage, or in other cases when a temperature in each chamber 122 and 124 (such as may be measured by chamber temperature sensor(s), as described above) is significantly greater than a respective set temperature or target temperature for each chamber 122 and 124. Accordingly, the intermediate position may include opening all four dampers. For example, the first damper 212 may be open at the first inlet 204 to permit air flow from the fresh food chamber 122 into the bridge chamber 200 via the first inlet 204, the second damper 214 may be open at the first outlet 206 to permit air flow from the bridge chamber 200 into the fresh food chamber 122 via the first outlet 206, the third damper 216 may be open at the second inlet 208 to permit air flow from the freezer chamber 124 into the bridge chamber 200 via the second inlet 208, and the fourth damper 218 may be open at the second outlet 210 to permit air flow from the bridge chamber 200 into the freezer chamber 124 via the second outlet 210, all at the same time, when in the intermediate position. The cooldown mode may also include operating a variable speed compressor (224, see, e.g., FIGS. 4 and 6) at a speed higher than during fresh food mode or freezer mode, while the damper assembly is in the all open position.

In at least some embodiments, the movable damper assembly may also be movable to a fully closed or all closed position, such that air flow between the bridge chamber 200 and the fresh food chamber 122 is obstructed or prevented at the same time as air flow between the bridge chamber 200 and the freezer chamber 124 is also obstructed or prevented. The all closed position may be used, for example, when defrosting the evaporator, in order to prevent the relatively warm defrosting air from travelling into the relatively cold fresh food chamber 122 and freezer chamber 124. As those of ordinary skill in the art will recognize, the defrost mode may include activating a defrost heater (not specifically illustrated) proximate to, e.g., in contact with, the evaporator 220 to remove, e.g., melt, frost which may accumulate on or around the evaporator 220 during operation (and the melt water may be collected and drained away from the fresh food chamber 122 and freezer chamber 124).

Additionally, the fan 222 may be activated during the defrost mode, e.g., to provide more thorough, uniform, and/or rapid defrosting of the evaporator (without urging any of the heated air into either the fresh food chamber 122 or the freezer chamber 124 because the damper assembly is fully closed).

Still referring to FIGS. 3-6 in general, the refrigerator appliance 100 may further include a plurality of plenums within the bridge chamber 200. For example, the evaporator 220 and the fan 222 may be spaced apart from each other within the bridge chamber 200 and spaced apart from the inlets (204 and 208) and outlets (206 and 210) of the bridge chamber 200, to thereby define the plenums within the bridge chamber 200. For example, the refrigerator appliance 100 may include a first plenum 230 within the bridge chamber 200 upstream of the fresh food chamber 120 and/or freezer chamber 124, such as the first plenum 230 may be downstream of the evaporator 220, e.g., immediately downstream of the evaporator 220 as illustrated. Thus, in some embodiments, e.g., as illustrated in FIGS. 3-6, the first plenum 230 may be defined between the evaporator 220 and the outlets 206 and 210 of the bridge chamber 200. In additional embodiments, the positions of the fan 222 and the evaporator 220 may be reversed, e.g., the fan 222 may be downstream of the evaporator 220, such that the first plenum 230 would be defined between the fan 222 and the outlets 206 and 210 of the bridge chamber 200.

Also by way of example, the refrigerator appliance 100 may include a second plenum 234 within the bridge chamber 200 downstream of the fresh food chamber 120 and/or freezer chamber 124, such as the first plenum 230 may be upstream of the fan 222, e.g., immediately upstream of the fan 222 as illustrated. Thus, in some embodiments, e.g., as illustrated in FIGS. 3-6, the second plenum 234 may be defined between the inlets 204 and 208 of the bridge chamber 200 and the fan 222. In additional embodiments where the positions of the fan 222 and the evaporator 220 are reversed, the second plenum 234 may be defined between the inlets 204 and 208 of the bridge chamber 200 and the evaporator 220.

In some embodiments, the first damper 212 and the third damper 216 may be positioned in and movable through the second plenum 234, while the second damper 214 and the fourth damper 218 may be positioned in and movable through the first plenum 230. In some embodiments, the evaporator 220 and the fan 222 may be spaced apart from each other, such that an intermediate plenum 232 may be defined between the evaporator 220 and the fan 222, such as directly and immediately between the evaporator 220 and the fan 222, e.g., as illustrated.

In some embodiments, the refrigerator appliance 100, e.g., the sealed cooling system thereof, may further include a variable speed compressor 224 (FIGS. 4 and 6) coupled to the evaporator 220. The controller 160 may be in operative communication with the variable speed compressor 224, such as to operate the variable speed compressor 224 at a plurality of speeds within an operating range of the variable speed compressor 224. The operating speed of the variable speed compressor 224 may control a flow rate of liquid phase refrigerant to the evaporator 220, and thus control the rate of cooling provided by the sealed cooling system. In such embodiments, the controller 160 may be configured to operate the variable speed compressor 224 at a first speed when the damper assembly is in the first position and to operate the variable speed compressor 224 at a second speed different from the first speed when the damper assembly is in the second position. For example, the variable speed compressor 224 may be operated at a higher rate to provide increased cooling when in freezer mode (e.g., when the damper assembly is in the second position) and may be operated at a lower rate to provide increased efficiency when in fresh food mode (e.g., when the damper assembly is in the first position).

Figure 3:
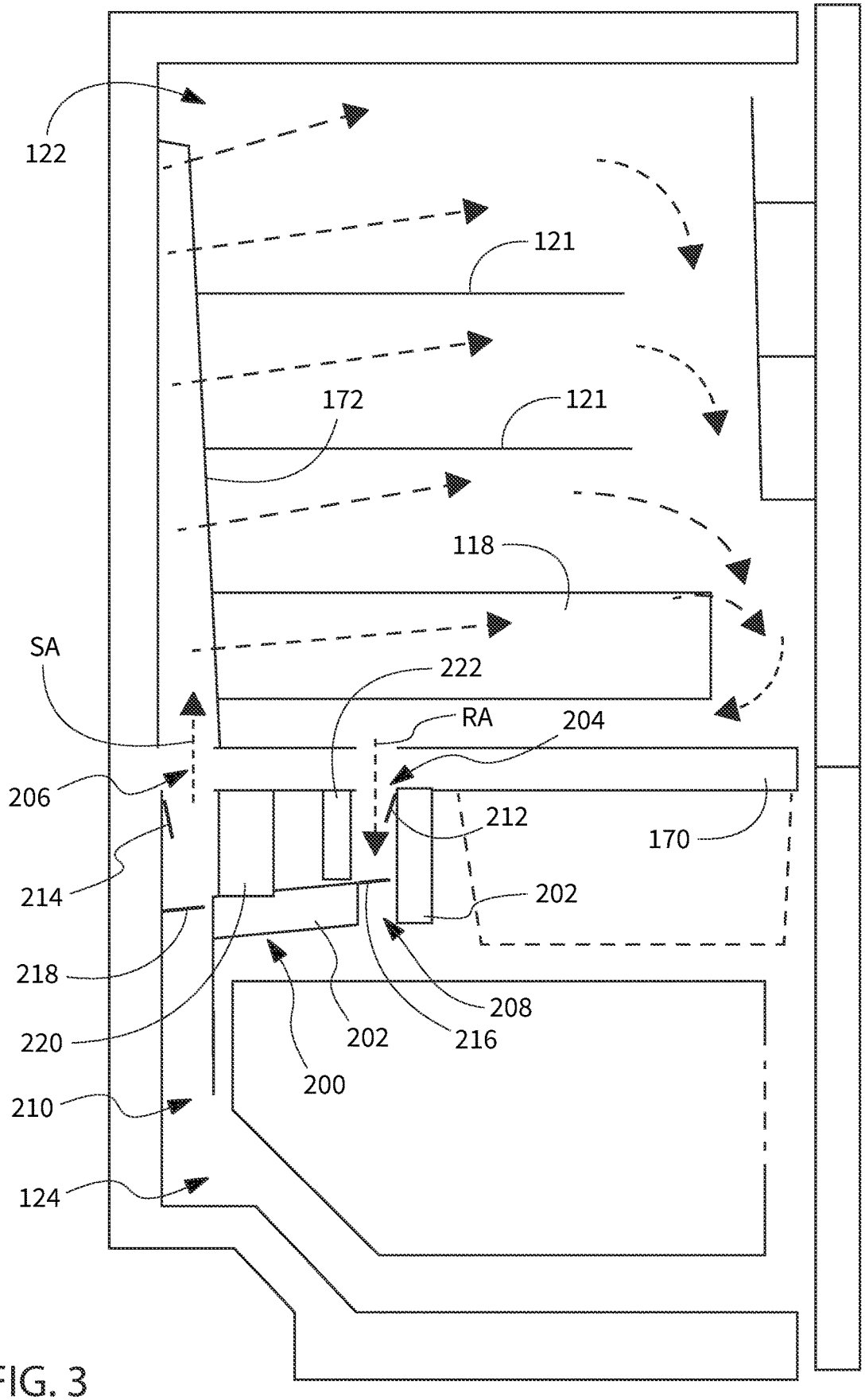
FIG. 3 provides a schematic side section view of the exemplary refrigerator appliance of FIG. 1 with a damper assembly in a first position.
Figure 4:
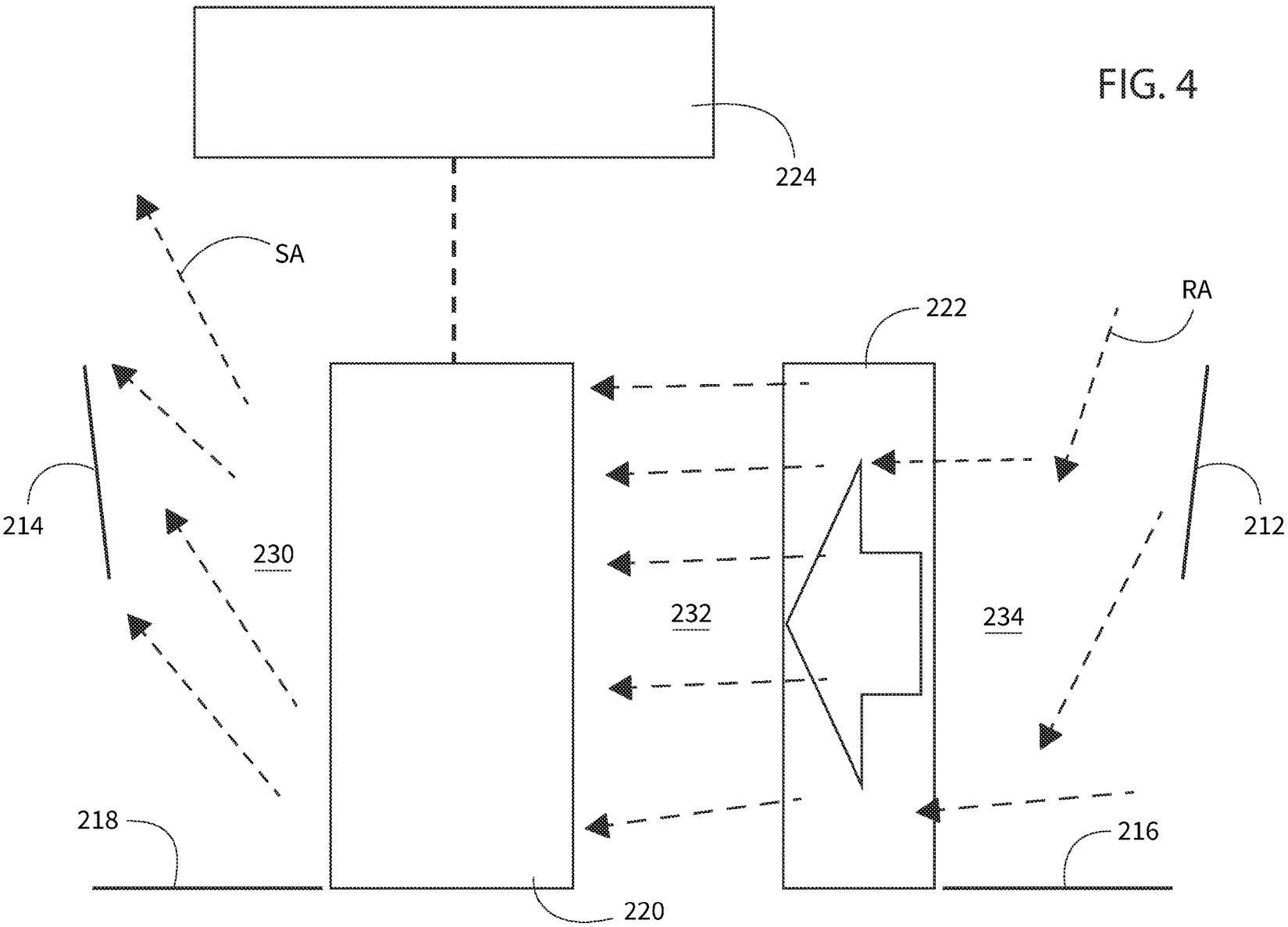
FIG. 4 provides an enlarged view of a portion of FIG. 3.

An exemplary fresh food mode is illustrated in FIGS. 3 and 4, e.g., where the damper assembly (comprising first damper 212, second damper 214, third damper 216, and fourth damper 218) is in the first position, such that air flow from the bridge chamber 200 to the freezer chamber 124 is obstructed, and air flow is guided to the fresh food chamber 122. As may be seen in FIG. 3, when in the fresh food mode, a flow of supply air SA is provided to the fresh food chamber 122 from the bridge chamber 200 via the first outlet 206. In some embodiments, an aperture (not labelled) may be defined through the insulated mullion 170 at the first outlet 206, such that the supply air SA is directed to the fresh food chamber 122 via the aperture through the insulated mullion 170 at the first outlet 206 of the bridge chamber 200. In some embodiments, the refrigerator appliance 100 may further include an air tower 172 through which the supply air SA is directed into and distributed in the fresh food chamber 122 through multiple outlets of the air tower, such as the air tower 172 may include an outlet at one or more storage elements in the fresh food chamber, such as at each drawer 118 and shelf 121 within the fresh food chamber 122. In such embodiments, the first outlet 206 of the bridge chamber 200 may be upstream of the air tower 172 in the fresh food chamber 122. After circulating through the fresh food chamber 122, the air may return to the bridge chamber 200, such as a flow of return air RA may enter the bridge chamber 200 at the first inlet 204 while in the fresh food mode, such as the return air RA may flow through another aperture in the insulated mullion to reach the first inlet 204 of the bridge chamber 200.

An exemplary freezer mode is illustrated in FIGS. 5 and 6, e.g., where the damper assembly (comprising first damper 212, second damper 214, third damper 216, and fourth damper 218) is in the second position, such that air flow from the bridge chamber 200 to the fresh food chamber 122 is obstructed, and air flow is guided to the freezer chamber 124. As may be seen in FIG. 5, when in the freezer mode, the flow of supply air SA is provided to the freezer chamber 124 from the bridge chamber 200 via the second outlet 210. In some embodiments, the second outlet 210 may open directly into the freezer chamber 124. In some embodiments, air flow within and through the freezer chamber 124 may be guided by (e.g., around) one or more storage elements, such as drawer 132, e.g., as illustrated in FIG. 5. As may be seen in FIG. 5, drawer 132 defines a portion of a flow path for chilled air within the freezer chamber 124, e.g., from the second outlet 210 of the bridge chamber 200 across a floor of the freezer chamber 200 and upwards at the front of the freezer chamber 124. After circulating through the freezer chamber 124, the air may return to the bridge chamber 200, such as the return air RA may enter directly into the bridge chamber 200 at the second inlet 208 while in the freezer mode.

Figure 7:
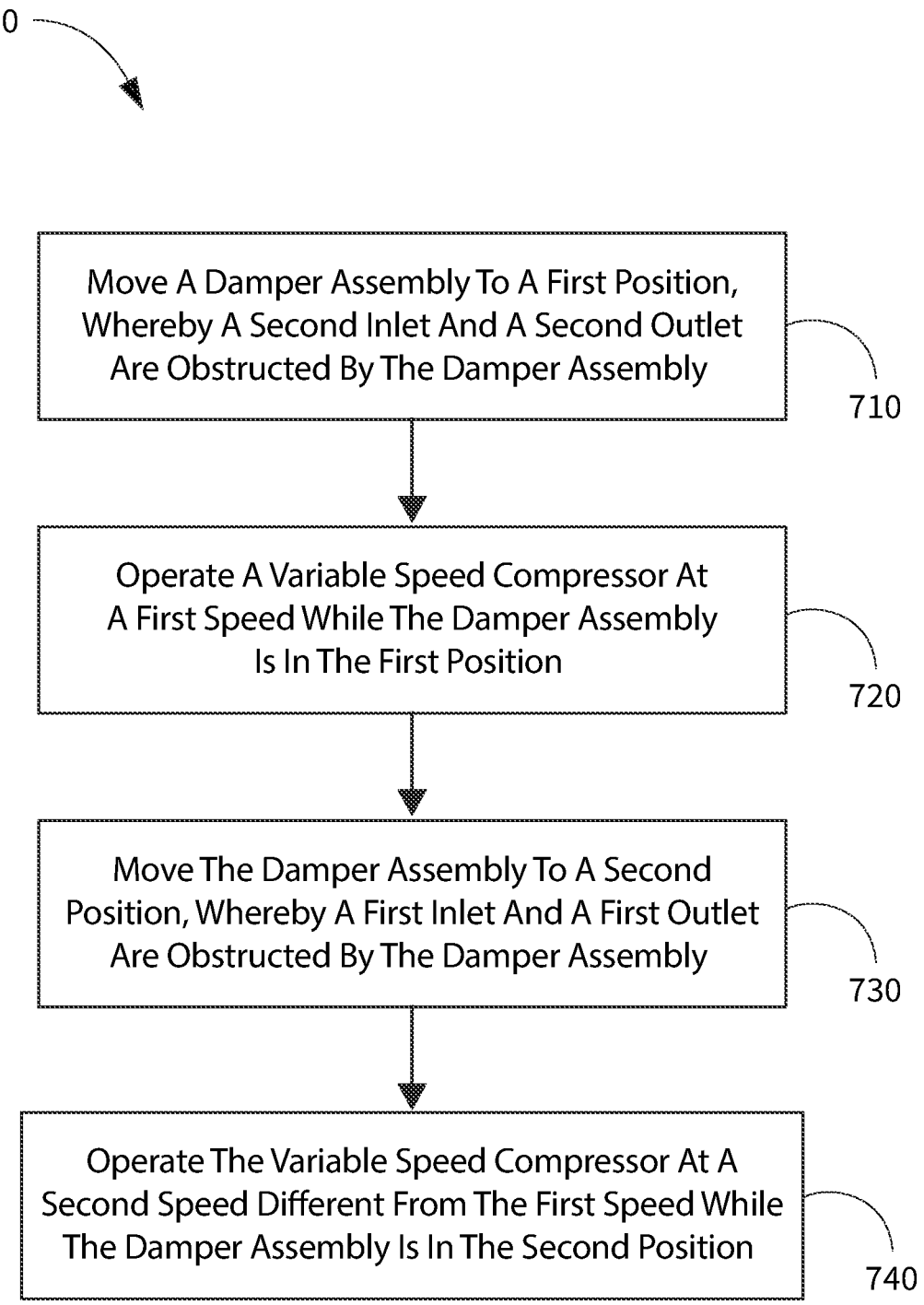
FIG. 7 provides a flowchart illustrating an exemplary method of operating a refrigerator appliance according to one or more exemplary embodiments of the present subject matter.

Turning now to FIG. 7, embodiments of the present disclosure may also include methods of operating a refrigerator appliance, such as the exemplary method 700. Such methods may be usable with any suitable refrigerator appliance, such as but not limited to the exemplary refrigerator appliance 100 described hereinabove.

For example, method 700 may be usable for operating a refrigerator appliance which includes a cabinet, a fresh food chamber defined in the cabinet, and a freezer chamber defined in the cabinet. For example, the freezer chamber may be spaced apart from the fresh food chamber and separated from the fresh food chamber by an insulated mullion. Such refrigerator appliance which may be operated according to method 700 may also include a bridge chamber defined in the cabinet. The bridge chamber may be positioned between the fresh food chamber and the freezer chamber. The bridge chamber may include a first inlet in fluid communication with the fresh food chamber, a first outlet in fluid communication with the fresh food chamber, a second inlet in fluid communication with the freezer chamber, and a second outlet in fluid communication with the freezer chamber. The refrigerator appliance may further include a movable damper assembly, an evaporator positioned in the bridge chamber, and a fan positioned in the bridge chamber. As illustrated in FIG. 7, method 700 may include (710) moving the movable damper assembly to a first position, whereby the second inlet and the second outlet are obstructed by the damper assembly in the first position.

An exemplary refrigerator appliance which may be operated according to method 700 may also include a variable speed compressor. In such embodiments, method 700 may further include (720) operating the variable speed compressor at a first speed while the damper assembly is in the first position. Method 700 may also include (730) moving the movable damper assembly to a second position, whereby the first inlet and the first outlet are obstructed by the damper assembly in the second position. As illustrated at (740) in FIG. 7, method 700 may further include operating the variable speed compressor at a second speed different from the first speed, such as greater than the first speed, while the damper assembly is in the second position.

In some embodiments, method 700 may further include moving the damper assembly to a third position, whereby the first inlet, the first outlet, the second inlet, and the second outlet are obstructed by the damper assembly in the third position. Such embodiments may further include activating a defrost heater proximate the evaporator while the damper assembly is in the third position.

In some embodiments, exemplary methods according to the present disclosure may further include operating the fan to urge air to the fresh food chamber from the bridge chamber while the movable damper assembly is in the first position, and operating the fan to urge air to the freezer chamber from the bridge chamber while the movable damper assembly is in the second position. In such embodiments, the first outlet may be upstream of an air tower in the fresh food chamber, and operating the fan while the movable damper assembly is in the first position may include urging, by the fan, air from the bridge chamber to the air tower. In some embodiments, the second outlet may open directly into the freezer chamber, and, in such embodiments, operating the fan while the movable damper assembly is in the second position may include urging, by the fan, air from the bridge chamber directly into the freezer chamber.

In some embodiments, the refrigerator appliance may further include a first plenum defined within the bridge chamber and a second plenum defined within the bridge chamber. In such embodiments, the movable damper assembly may include a first damper, a second damper, a third damper, and a fourth damper, and moving the movable damper assembly to the first position may include moving the first damper and the third damper within the first plenum and moving the second damper and the fourth damper within the second plenum, and moving the movable damper assembly to the second position may include moving the first damper and the third damper within the first plenum and moving the second damper and the fourth damper within the second plenum.

In some embodiments, the movable damper assembly may include a first damper positioned at the first inlet, a second damper positioned at the first outlet, a third damper positioned at the second inlet, and a fourth damper positioned at the second outlet. For example, the first damper and the third damper may selectively obstruct one of the inlets of the bridge chamber while the second damper and the fourth damper selectively obstruct one of the outlet of the bridge chamber in the first and second positions. In such embodiments, in the first position, the third damper may obstruct the second inlet and the fourth damper may obstruct the second outlet, whereas, in the second position, the first damper may obstruct the first inlet and the second damper may obstruct the first outlet.

Exemplary refrigerator appliances and methods of operating such appliances according to various embodiments of the present disclosure may provide numerous advantages. For example, operating a single evaporator as if it were two (e.g., operating the single evaporator as both a fresh food evaporator in a fresh food mode and as a freezer evaporator in a freezer mode) may advantageously provide energy savings as compared to multiple, e.g., two, separate evaporators. As another example, operating the compressor at different speeds in the different modes provides an overall savings in energy. For another example, using the single evaporator may provide an overall smaller cooling system as compared to systems with two or more evaporators. Additional exemplary advantages which may be provided include reduced part count and reduced costs for materials and assembly, and increased usable internal volume within the cabinet of the refrigerator appliance. Those of ordinary skill in the art will recognize that additional advantages may also be provided as well as or instead of the exemplary advantages described herein, and the advantages described herein are provided by way of example only and without limiting the present disclosure, e.g., the exemplary advantages are not required in some or all embodiments of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet;

a fresh food chamber defined in the cabinet;

a freezer chamber defined in the cabinet, the freezer chamber spaced apart from the fresh food chamber and separated from the fresh food chamber by an insulated mullion;

an air tower in the fresh food chamber, the air tower comprising multiple outlets configured to direct and distribute a flow of air into the fresh food chamber;

a drawer slidably mounted within the freezer chamber;

a bridge chamber defined in the cabinet, the bridge chamber defined by the insulated mullion and an insulated partition, the bridge chamber positioned between the fresh food chamber and the freezer chamber, the bridge chamber comprising a first inlet in fluid communication with the fresh food chamber, the first inlet defined in the insulated mullion, a first outlet in fluid communication with the fresh food chamber via the air tower to provide the flow of air into the fresh food chamber from the bridge chamber through the multiple outlets of the air tower, a second inlet in fluid communication with the freezer chamber, the second inlet defined in the insulated partition, and a second outlet in fluid communication with the freezer chamber, wherein the second outlet opens directly into the freezer chamber, and wherein the drawer defines a portion of a flow path within the freezer chamber for chilled air from the second outlet;

an evaporator positioned in the bridge chamber;

a fan positioned in the bridge chamber; and a movable damper assembly configured to move between a first position and a second position, wherein the second inlet and the second outlet are obstructed by the damper assembly in the first position and wherein the first inlet and the first outlet are obstructed by the damper assembly in the second position, wherein the movable damper assembly comprises a first damper positioned at the first inlet, a second damper positioned at the first outlet upstream of the air tower, a third damper positioned at the second inlet, and a fourth damper positioned at the second outlet, wherein the third damper obstructs the second inlet in the first position and the fourth damper obstructs the second outlet in the first position, and wherein the first damper obstructs the first inlet in the second position and the second damper obstructs the first outlet in the second position, each damper movable independently of every other damper, wherein the evaporator in the bridge chamber is the only evaporator of the refrigerator appliance.

2. The refrigerator appliance of claim 1, wherein the movable damper assembly is further configured to move to a third position, wherein the first inlet, the first outlet, the second inlet, and the second outlet are obstructed by the damper assembly in the third position, the refrigerator appliance further comprising a controller, the controller configured for moving the damper assembly to the third position and defrosting the evaporator while the damper assembly is in the third position.

3. The refrigerator appliance of claim 1, further comprising a plenum defined within the bridge chamber between the evaporator and the fan.

4. The refrigerator appliance of claim 1, further comprising a first plenum defined within the bridge chamber and a second plenum defined within the bridge chamber, the first damper and the third damper positioned in the first plenum, the second damper and the fourth damper positioned in the second plenum.

5. The refrigerator appliance of claim 1, further comprising a variable speed compressor coupled to the evaporator and a controller in operative communication with the variable speed compressor, the controller configured to operate the variable speed compressor at a first speed when the damper assembly is in the first position and to operate the variable speed compressor at a second speed different from the first speed when the damper assembly is in the second position.

6. A method of operating a refrigerator appliance, the refrigerator appliance comprising a cabinet, a fresh food chamber defined in the cabinet, a freezer chamber defined in the cabinet, the freezer chamber spaced apart from the fresh food chamber and separated from the fresh food chamber by an insulated mullion, a bridge chamber defined in the cabinet, the bridge chamber defined by the insulated mullion and an insulated partition, the bridge chamber positioned between the fresh food chamber and the freezer chamber, the bridge chamber comprising a first inlet in fluid communication with the fresh food chamber, a first outlet in fluid communication with the fresh food chamber, a second inlet in fluid communication with the freezer chamber, and a second outlet in fluid communication with the freezer chamber, the refrigerator appliance further comprising a movable damper assembly, an evaporator positioned in the bridge chamber, and a fan positioned in the bridge chamber, wherein the evaporator in the bridge chamber is the only evaporator of the refrigerator appliance, the method comprising:

moving the movable damper assembly to a first position, whereby a first flow of return air to the bridge chamber from the fresh food chamber through the first inlet and the insulated mullion is permitted by a first damper of the damper assembly and a first flow of supply air from the bridge chamber to the fresh food chamber via the first outlet and an air tower in the fresh food chamber is permitted by a second damper of the damper assembly, the air tower comprising multiple outlets, wherein the first flow of supply air is directed and distributed to the fresh food chamber by the multiple outlets of the air tower, and whereby the second inlet is obstructed by a third damper of the damper assembly and the second outlet is obstructed by a fourth damper of the damper assembly in the first position; and moving the movable damper assembly to a second position, whereby a second flow of return air to the bridge chamber from the freezer chamber through the second inlet and the insulated partition is permitted by the third damper and a second flow of supply air from the bridge chamber to the freezer chamber through the second outlet is permitted by the fourth damper, wherein a drawer slidably mounted in the freezer chamber defines a portion of a flow path for the second flow of supply air, and whereby the first inlet is obstructed by the first damper of the damper assembly and the first outlet is obstructed by the second damper of the damper assembly in the second position, wherein moving the movable damper assembly to the first position and moving the movable damper assembly to the second position each comprises moving each damper independently of every other damper.

7. The method of claim 6, further comprising moving the damper assembly to a third position, whereby the first inlet, the first outlet, the second inlet, and the second outlet are obstructed by the damper assembly in the third position, and defrosting the evaporator while the damper assembly is in the third position.

8. The method of claim 6, wherein the refrigerator further comprises a variable speed compressor, the method further comprising:

operating the variable speed compressor at a first speed while the damper assembly is in the first position; and operating the variable speed compressor at a second speed different from the first speed while the damper assembly is in the second position.

9. The method of claim 8, wherein the second speed is greater than the first speed.

10. The method of claim 6, further comprising operating the fan to urge the first flow of supply air to the fresh food chamber from the bridge chamber while the movable damper assembly is in the first position, and operating the fan to urge the second flow of supply air to the freezer chamber from the bridge chamber while the movable damper assembly is in the second position.

11. The method of claim 10, wherein operating the fan while the movable damper assembly is in the first position comprises urging, by the fan, the first flow of supply air from the bridge chamber to the air tower, wherein the second outlet opens directly into the freezer chamber, and wherein operating the fan while the movable damper assembly is in the second position comprises urging, by the fan, the second flow of supply air from the bridge chamber directly into the freezer chamber.

12. The method of claim 6, wherein the refrigerator appliance further comprises a first plenum defined within the bridge chamber and a second plenum defined within the bridge chamber, wherein moving the movable damper assembly to the first position comprises moving the first damper and the third damper within the first plenum and moving the second damper and the fourth damper within the second plenum, and wherein moving the movable damper assembly to the second position comprises moving the first damper and the third damper within the first plenum and moving the second damper and the fourth damper within the second plenum.

* * * * *